US008578874B2

(12) United States Patent
Withers

(10) Patent No.: US 8,578,874 B2
(45) Date of Patent: Nov. 12, 2013

(54) SPRAY CAPS FOR GENERATING SPRAYING SOUNDS HAVING ENHANCED PERCEIVED LOUDNESS

(75) Inventor: Philip Craig Withers, South Bank (AU)

(73) Assignee: International Consolidated Business Pty Ltd., Melbourne, Victoria (AU)

( * ) Notice: Subject to any disclaimer, the term of this patent is extended or adjusted under 35 U.S.C. 154(b) by 413 days.

(21) Appl. No.: 11/991,860

(22) PCT Filed: Sep. 22, 2006

(86) PCT No.: PCT/AU2006/001390

§ 371 (c)(1),
(2), (4) Date: Sep. 10, 2008

(87) PCT Pub. No.: WO2007/033426

PCT Pub. Date: Mar. 29, 2007

(65) Prior Publication Data

US 2009/0032617 A1 Feb. 5, 2009

(30) Foreign Application Priority Data

Sep. 23, 2005 (AU) ..... 2005905268

(51) Int. Cl.

| | |
|---|---|
| ***B05B 7/32*** | (2006.01) |
| ***F23D 11/24*** | (2006.01) |
| ***F23D 14/28*** | (2006.01) |
| ***B06B 3/00*** | (2006.01) |

(52) U.S. Cl.
USPC ..... 116/137 R; 116/137 A; 239/337; 239/223

(58) Field of Classification Search
USPC ..... 239/337, 223, 381, 424, 424.5, 102.1, 239/589.1; 116/137 R, 142 FP, 137 A
See application file for complete search history.

(56) References Cited

U.S. PATENT DOCUMENTS

| | | | | | |
|---|---|---|---|---|---|
| 3,670,690 | A | * | 6/1972 | Swanson | 116/112 |
| 3,737,104 | A | | 6/1973 | Schneider | |
| 4,532,996 | A | * | 8/1985 | Wilson et al. | 169/23 |
| 4,858,792 | A | * | 8/1989 | de Laforcade | 222/533 |
| 4,970,983 | A | * | 11/1990 | LeBlanc et al. | 116/142 FP |
| 5,136,964 | A | * | 8/1992 | Vidovic et al. | 116/26 |
| 5,355,830 | A | * | 10/1994 | deJong | 116/142 FP |
| 2003/0089734 | A1 | * | 5/2003 | Eberhardt et al. | 222/39 |
| 2004/0164103 | A1 | * | 8/2004 | Uemura et al. | 222/402.14 |

FOREIGN PATENT DOCUMENTS

| | | | |
|---|---|---|---|
| DE | 28 03 993 | A1 | 8/1978 |
| FR | 1 603 001 | | 4/1971 |
| FR | 2742056 | A | 6/1997 |
| GB | 2 404 223 | A | 1/2005 |
| JP | 57054821 | A | 4/1982 |
| JP | 2002-346442 | A | 12/2002 |
| WO | WO 2004/014129 | A | 2/2004 |

OTHER PUBLICATIONS

Supplementary European Search Report from European Application No. 06775011, dated Nov. 5, 2009.

* cited by examiner

*Primary Examiner* — Len Tran
*Assistant Examiner* — Justin Jonaitis
(74) *Attorney, Agent, or Firm* — K&L Gates LLP

(57) ABSTRACT

A spray cap for generating a spraying sound having enhanced perceived loudness, the spray cap having an acoustic structure provided around a nozzle to modify a spraying sound produced by spraying through the nozzle as a function of sound pressure level and frequency into a modified spraying sound having a sound spectrum in a sensitive part of the spectrum of human hearing.

5 Claims, 3 Drawing Sheets

SPRAY CAPS FOR GENERATING SPRAYING SOUNDS HAVING ENHANCED PERCEIVED LOUDNESS

RELATED APPLICATIONS

This application is the U.S. National Stage of International Application No. PCT/AU2006/001390, filed Sep. 22, 2006, published in English, and claims priority under 35 U.S.C. §119 or 365 to Australian Application No. 2005 905268, filed Sep. 23, 2005.

FIELD OF THE INVENTION

The present invention relates to spray caps for consumer spray products, for example, consumer aerosol or pump spray products.

BACKGROUND OF THE INVENTION

Loudness is the most basic information contained in a sound signal. In consumer aerosol or pump spray products, the loudness of the spraying sound can audibly convey useful information to consumers. For example, loudness can audibly warn when spraying is activated. Loudness can also audibly indicate characteristics of spraying, for example, spray rate, spray quantity, spray quantity, spray range, etc.

The safety and efficacy of consumer spray products can therefore be improved by enhancing (or increasing) the perceived (or perceptual) loudness of their spraying sound.

SUMMARY OF THE INVENTION

According to the present invention, there is provided a spray cap for generating a spraying sound having enhanced perceived loudness, the spray cap having an acoustic structure provided around a nozzle to modify a spraying sound produced by spraying through the nozzle as a function of sound pressure level and frequency into a modified spraying sound having a sound spectrum in a sensitive part of the spectrum of human hearing.

The sound pressure levels of the modified spraying sound can range from around 65 dB to around 100 dB at frequencies in a range of around 2 kHz to around 6 kHz. Preferably, the sound pressure levels of the modified spraying sound range from around 80 dB to around 90 dB at frequencies in a range of around 3 kHz to around 5 kHz. More preferably, the sound pressure levels of the modified spraying sound peak in a range from around 85 dB to around 90 dB at a peak frequency of around 4 kHz. Further preferably, the sound spectrum of the modified spraying sound has a generally inverted cup or inverted "U" shape when viewed as a function of sound pressure level and frequency between around 2 kHz and around 6 kHz.

The modified spraying sound can audibly warn when spraying through the nozzle is activated. The modified spraying sound can audibly indicate information about spraying through the nozzle selected from spray rate, spray quantity, spray quality, spray range, spray efficacy, and combinations thereof.

The acoustic structure can be a hollow, generally rectangular parallelepiped. The hollow, generally rectangular parallelepiped can have a curved upper rear internal surface. The internal surface area of the hollow, generally rectangular parallelepiped can be substantially smooth.

The spray cap can further include a skirt having a peripheral lip adapted to snap-fit on top of a spray container. The peripheral lip can have an offset hanger portion adapted to removably hang a spray container in a vertical direction longitudinal to and substantially parallel to a wall when the spray cap is snap-fitted on top of a spray container. The offset hanger portion can be adapted to removably engage a complementary upstanding hook provided on a wall storage bracket. The offset hanger portion and the complementary upstanding hook can be arcuate in horizontal section.

The nozzle, acoustic structure and skirt can be integrally formed with an actuator. The nozzle, acoustic structure, skirt and actuator can be formed as an integral moulding in plastics.

The present invention also provides a spray product for generating a spraying sound having enhanced perceived loudness, the spray product having the above spray cap mounted on a spray container containing spray liquid and/or propellant. The spray product can be an aerosol spray product or a pump spray product.

The present invention further provides a method for enhancing a perceived loudness of a spraying sound generated by a spray cap, the method including the steps of:

- providing an acoustic structure around a nozzle of a spray cap;
- configuring the acoustic structure to modify a spraying sound produced by spraying through the nozzle as a function of sound pressure level and frequency into a modified spraying sound having a sound spectrum in a sensitive part of the spectrum of human hearing.

The present invention also provides a method for enhancing a perceived loudness of a spraying sound generated by a spray cap having an acoustic structure provided around a nozzle, the method including selectively and individually configuring the nozzle and the acoustic structure to modify a spraying sound produced by spraying through the nozzle as a function of sound pressure level and frequency into a modified spraying sound having a sound spectrum in a sensitive part of the spectrum of human hearing.

The step of selectively and individually configuring the nozzle and the acoustic structure can be based at least in part on sound characteristics of spray liquid and/or propellant to be sprayed through the nozzle.

The present invention also provides a kit of parts including a spray cap, a spray container and a wall storage bracket, the spray cap including an acoustic structure provided around a nozzle to modify a spraying sound produced by spraying through the nozzle as a function of sound pressure level and frequency into a modified spraying sound having a sound spectrum in a sensitive part of the spectrum of human hearing, the spray cap further including a skirt having a peripheral lip adapted to mount the spray cap on top of the spray container, and the peripheral lip having an offset hanger portion adapted to removably engage a complementary upstanding hook provided on the wall storage bracket, wherein the spray cap and the wall storage bracket cooperate to removably store the spray container in a vertical direction longitudinal to and substantially parallel to a wall when the spray cap is mounted on top of the spray container.

BRIEF DESCRIPTION OF THE DRAWINGS

The present invention will now be described by way of example only with reference to the accompanying drawings, in which.

DETAILED DESCRIPTION

Figure 1:
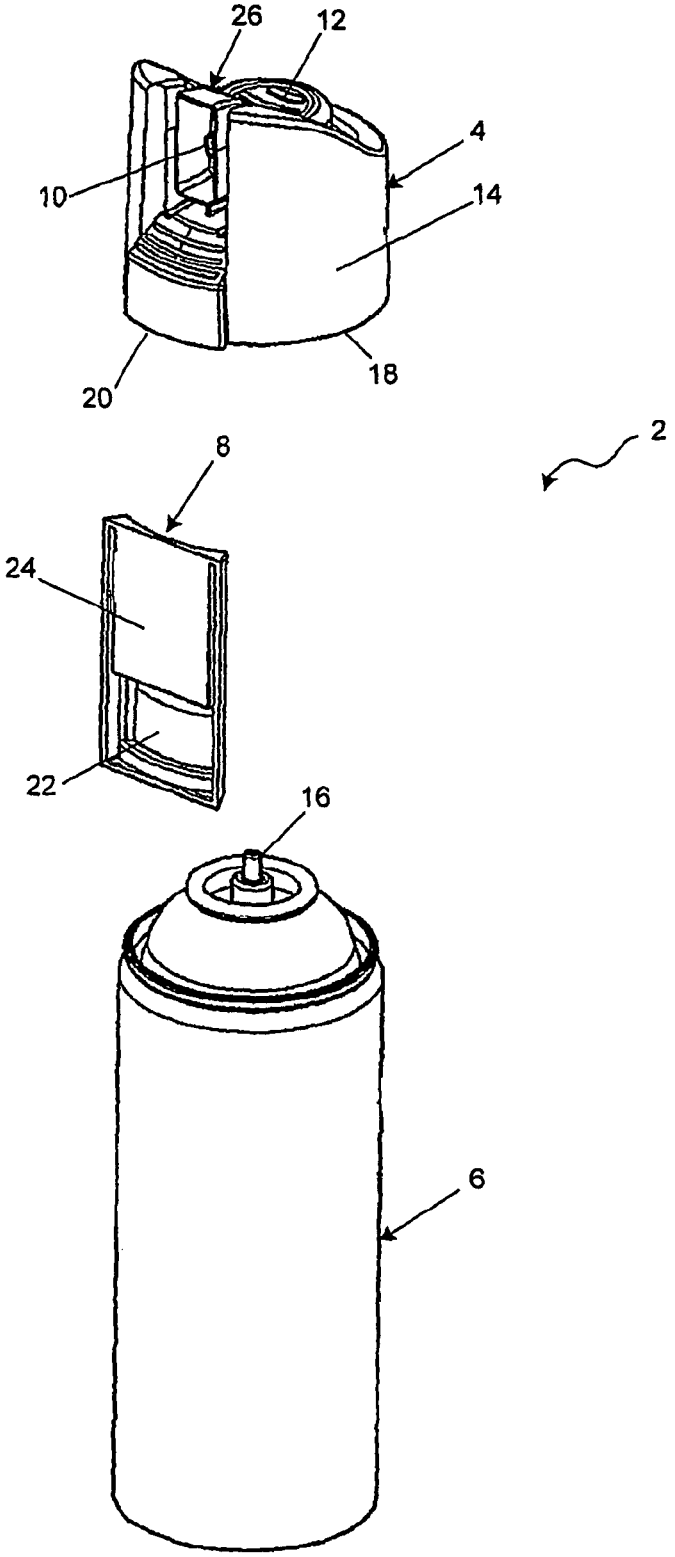
FIG. 1 is an exploded perspective view of a consumer spray product including a spray cap of an embodiment of the invention, a spray container and a wall storage bracket.
Figure 2:
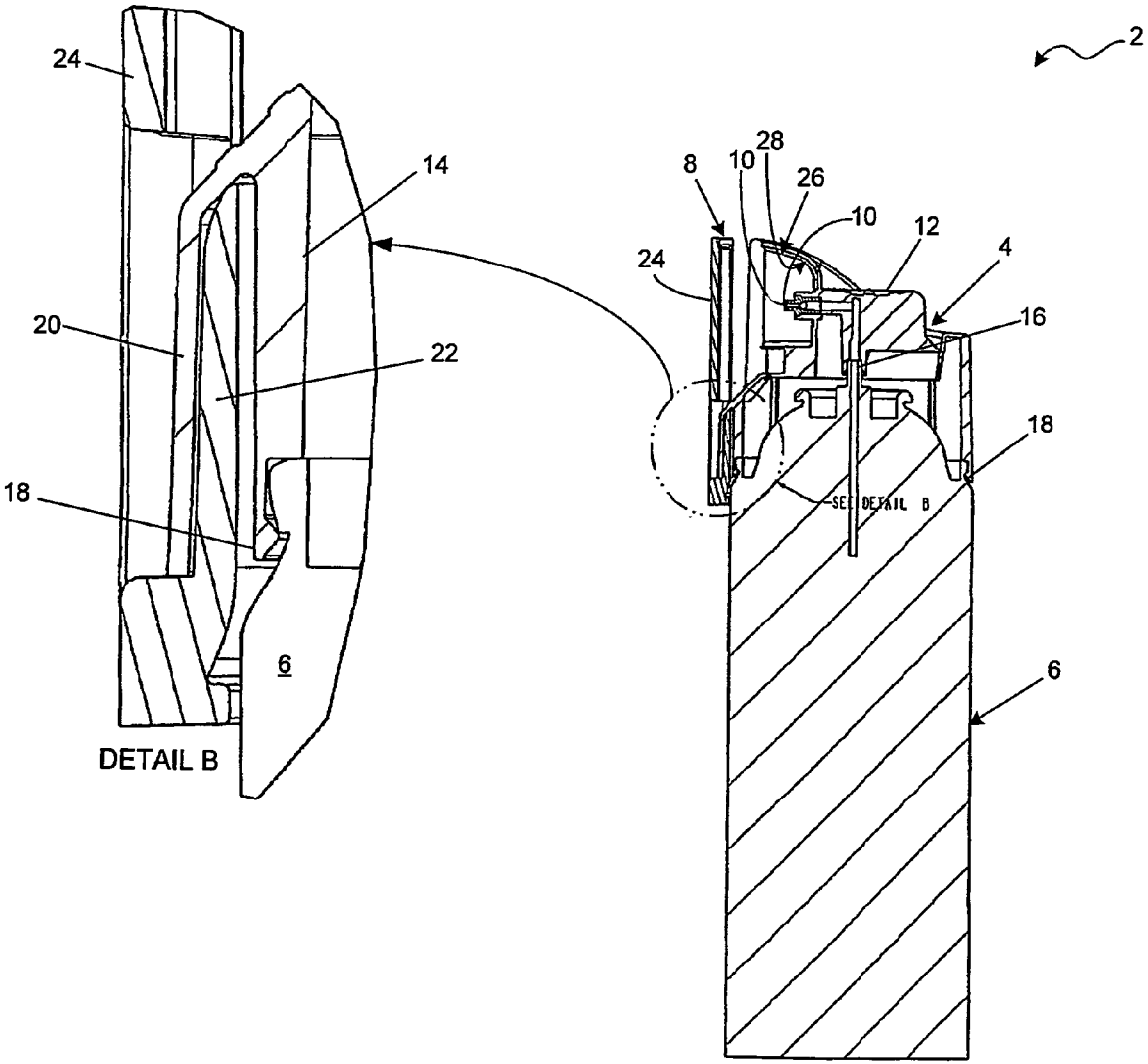
FIG. 2 is a section through the spray product of FIG. 1.

FIGS. 1 and 2 illustrate a consumer spray product 2 that generally includes a spray cap 4 of an embodiment of the invention, a spray container 6 and a wall storage bracket 8. The spray container 6 is, for example, an aluminium (or tinplate) cylindrical (or ovoid) aerosol can containing liquid and propellant. The spray cap 4 is, for example, a spray-through cap formed with a nozzle 10, an actuator 12 and a skirt 14 as an integral moulding in plastics, such as polypropylene.

When the spray cap 4 is placed on top of the spray container 6, the nozzle 10 is fluidly connected to a valve 16 of the spray container 6. The valve 16 is selectively activated by downwards finger pressure on the actuator 12. The skirt 14 has a peripheral lip 18 that snap-fits on top of the spray container 6. The peripheral lip 18 has an offset hanger portion 20 to removably engage a complementary upstanding hook 22 on the wall storage bracket 8. The wall storage bracket 8 can be fixed to a wall (not shown) by an adhesive strip 24. The complementary parts of the spray cap 4 and the wall storage bracket 8 have a curvature in horizontal section that generally corresponds to the external curvature of the spray container 6. The spray cap 4 and the wall storage bracket 8 cooperate to allow the consumer spray product 2 to be stored in a vertical direction longitudinal to and substantially parallel to a wall when not in use.

An acoustic structure 26 is provided around the opening of the nozzle 10. The acoustic structure 26 is provided between two spaced internal transverse walls lying in a vertical plane and extending downwards from the top of the spray cap 4. The acoustic structure 26 is, for example, a hollow, generally rectangular parallelepiped with a curved upper rear internal surface 28. The internal surface area of the acoustic structure 26 is substantially smooth and free of surface features such as ribs, grooves, roughening, etc. The acoustic structure 26 has, for example, an internal height of 28 mm, an internal width of 12.5 mm, and an internal depth of 14 mm. The opening of the nozzle 10 projects into the acoustic structure 26 by 7.5 mm, so that the internal distance between the opening of the nozzle 10 and the front opening of the acoustic structure 26 is 5 mm. The opening of the nozzle 10 is, for example, a vertical slot that produces a fan-like vertical spray pattern. Other shapes, configurations and dimensions are possible for the acoustic structure, nozzle and spray pattern, for example, hollow, continuous frustoconical or frustopyramidal structures, circular nozzle openings, cone-like spray patterns, etc.

When the consumer spray product 2 is activated, the spray cap 4 generates a spraying sound having enhanced (or increased) perceived (or perceptual) loudness. The acoustic structure 26 of the spray cap 4 passively modifies sound produced by spraying through the nozzle 10 by translating, transducing, amplifying, and/or converting its tones, subtones and component frequencies and levels into those in a sensitive part of the spectrum of human hearing. The acoustic structure 26 therefore modifies the spraying sound as a function of frequency and level (or amplitude) to thereby increase its perceived loudness.

The human ear subjectively perceives loudness in a complex way that depends on frequency and level. The human ear preferentially perceives particular frequencies, or bands of frequencies, over others. Fletcher and Munson determined that human hearing is less sensitive at low and high frequencies than at middle (or voice) frequencies. They also found that the relative change in sensitivity decreased as the level of sound increased.

The acoustic structure 26 is tuned to modify a spraying sound produced by aerosol spraying through the nozzle 10 as a function of sound pressure level and frequency into a modified spraying sound having a sound spectrum in a sensitive part of the spectrum of human hearing. The sound pressure levels of the modified spraying sound generated by the spray cap 4 with the acoustic structure 26 can range from around 65 dB to around 100 dB at frequencies in a range of around 2 kHz to around 6 kHz. Sound pressure levels below around 65 dB are considered insufficient to audibly convey useful information about consumer spray products, while levels above around 100 dB are considered undesirable and unpleasant in consumer spray products. Preferably, the sound pressure levels of the modified spraying sound range from around 80 dB to around 90 dB at frequencies in a range of around 3 kHz to around 5 kHz. More preferably, the sound pressure levels of the modified spraying sound peak in a range from around 85 dB to around 90 dB at a peak frequency of around 4 kHz. The amplitude ceiling (highest amplitude sound pressure level in the sound) of around 85 dB and peak frequency of around 4 kHz (frequency at which the highest amplitude sound pressure level occurs) of the modified spray sound positively correlate with increased perceived loudness. Further preferably, the sound spectrum of the modified spraying sound has a generally inverted cup or inverted "U" shape when viewed as a function of sound pressure level and frequency between around 2 kHz and around 6 kHz.

Figure 3:
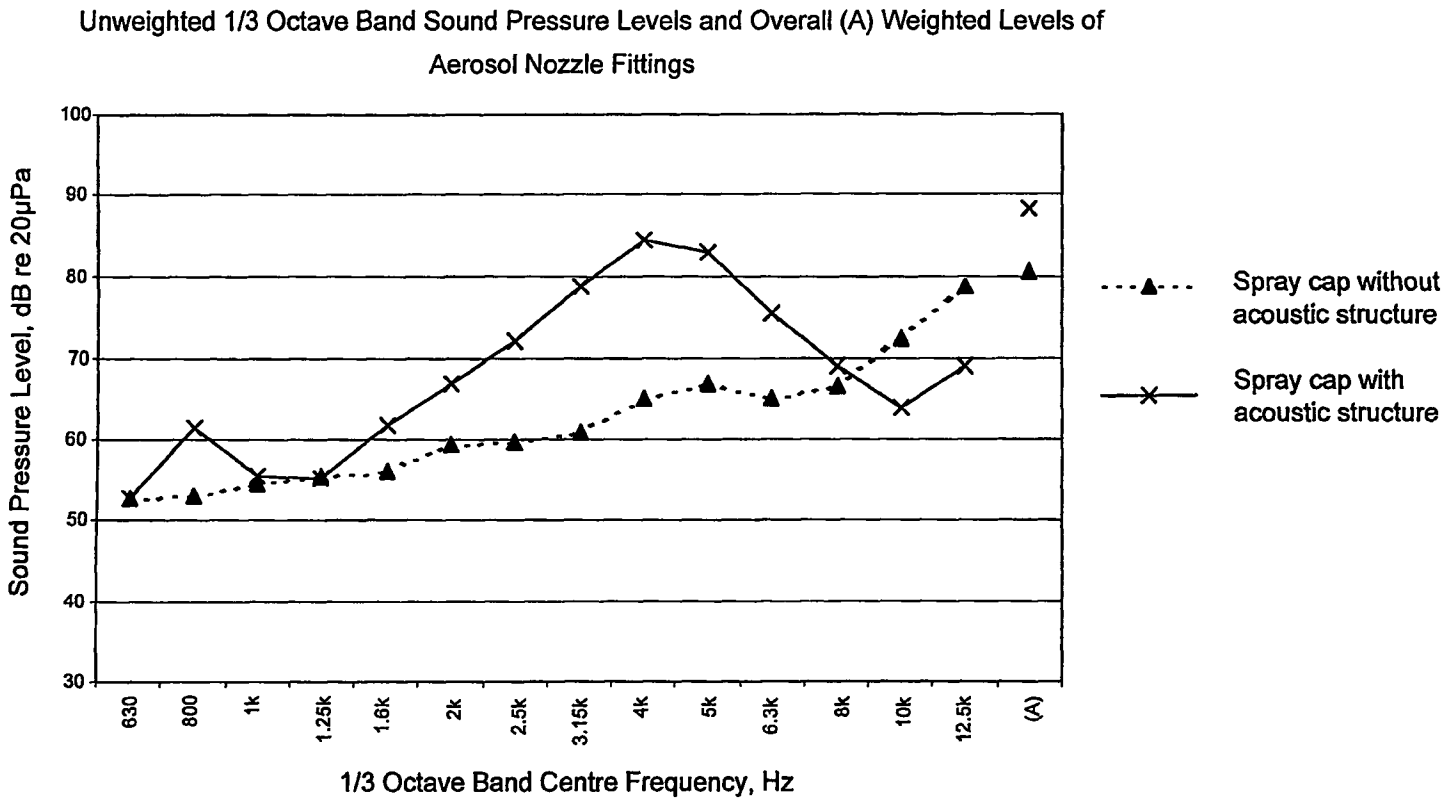
FIG. 3 are sound spectra of spraying sounds generated by the spray cap of FIG. 1 and a conventional spray nozzle.

FIG. 3 illustrates comparative sound spectra of spraying sounds generated by the spray cap 4 and a conventional aerosol spray cap having a nozzle without an acoustic structure. Compared to the conventional spray cap, the frequency/sound pressure level profile of the modified spraying sound generated by the spray cap 4 correlates with increased perceived loudness. In other words, the modified spraying sound generated by the spray cap 4 has enhanced perceptual loudness and greater auditory selectivity as a function of frequency and sound level. The sound pressure level of the spray cap 4 in the frequency range of around 3 kHz to around 5 kHz, and at the peak frequency of around 4 kHz, is around 20 dB greater than that of the conventional spray nozzle. This significant increase occurs at the point in the acoustic spectrum where the human ear is most sensitive. A 20 dB increase in level in this frequency sub-range is accepted as a factor of four change in loudness. In addition, the overall (A) weighted sound pressure level in dB(A) of the spray cap 4 is almost 10 dB greater than the conventional spray nozzle. The (A) weighted level is an accepted single number descriptor of sound level corresponding to human hearing. A change of 10 decibels in (A) weighted sound pressure level is accepted as an approximate factor of two change in loudness, that is a doubling of loudness. The sound spectra in FIG. 3 therefore indicate that the perceived change in loudness between the two spray caps falls between that indicated by the change in overall (A) weighted levels and the change in levels at 4 kHz. In other words, the perceived change in loudness is greater than a factor of two and less than a factor of four.

The increased perceived loudness of the spraying sound of the consumer spray product 2 generated by the spray cap 4 audibly conveys useful information to consumers. The increased perceived loudness audibly warns consumers when spraying through the nozzle is activated. In addition, the increased perceived loudness audibly indicates information about spraying through the nozzle selected from spray rate, spray quantity, spray quality, spray range, spray efficacy, etc.

Embodiments of the invention therefore provide spray caps and consumer spray products having improved safety and efficacy due to the enhanced perceived loudness of their spraying sound. The invention can be implemented with any and all conventional consumer aerosol or pump spray products, for example, cosmetic spray products, personal care spray products, paint spray products, automotive spray products, household/maintenance spray products, insecticidal spray products, industrial spray products, pharmaceutical spray products, food spray products, arts and craft spray products, shoe and leather care spray products, gardening spray products, etc. The shape, dimensions and arrangement of the acoustic structure, nozzle, spraying liquid and/or propellant can be selectively and individually varied to generate spraying sounds having sound pressure levels and frequencies that correlate with enhanced or increased perceived loudness which is subjectively considered to be desirable in consumer spray products.

The above embodiment has been described by way of example only and modifications are possible within the scope of the invention disclosed.

The invention claimed is:

1. A cap for an aerosol container having an actuatable valve, the cap comprising:

a vertically-movable valve actuator; and, a nozzle projecting laterally from the valve actuator into an acoustic structure having a planar bottom, side, and rear walls, and an arched top wall extending from the rear wall;

wherein the nozzle and the acoustic structure from a tuned acoustic system so that in use the nozzle in combination with the acoustic structure has a second perceived loudness that is enhanced relative to a first perceived loudness of the nozzle alone; and the cap further comprising a downwardly extending skirt adapted to snap-fit on a top rim of the aerosol container.

2. A cap according to claim 1, wherein the nozzle partially protrudes laterally into the acoustic structure through a slot formed in the rear wall thereof.

3. A cap according to claim 1, wherein the nozzle is spaced apart from and parallel to the bottom and side walls of the acoustic structure.

4. A cap according to claim 1, wherein the acoustic structure has a lateral depth of 14 mm, and the nozzle projects laterally into the passive acoustic structure by 7.5 mm.

5. A cap according to claim 1, wherein the valve-actuator, the nozzle, the acoustic structure, and the skirt are formed as an integral moulding in a plastic material.

* * * * *